United States Patent [19]

Ikio

[11] 3,948,397

[45] Apr. 6, 1976

[54] COKE OVEN DOOR LIFTER MECHANISM

[76] Inventor: Takatoshi Ikio, 5-32, 1-chome, Senbo, Tobata, Kitakyushu, Fukuoka, Japan

[22] Filed: Mar. 13, 1974

[21] Appl. No.: 450,778

[52] U.S. Cl. ..... 212/4; 202/248; 110/173 R

[51] Int. Cl.[2] ..... B66C 13/00

[58] Field of Search ..... 212/4; 202/247, 248, 270; 110/173 R

[56] References Cited

UNITED STATES PATENTS

| | | | |
|---|---|---|---|
| 2,183,753 | 12/1939 | Potter | 202/248 |
| 2,442,391 | 6/1948 | Wilputte | 202/248 |
| 2,478,215 | 8/1949 | Van Ackeren | 202/248 |
| 2,588,060 | 3/1952 | Tweit | 212/4 |
| 2,746,610 | 5/1956 | Henseleit | 212/4 |
| 2,746,611 | 5/1956 | Henseleil | 212/4 |
| 2,797,820 | 7/1957 | Homan | 212/4 |
| 2,850,173 | 9/1958 | Shimazaki | 212/4 |
| 3,014,746 | 12/1961 | Hiby | 212/4 X |

OTHER PUBLICATIONS

Coke & Gas June, 1947; pp. 175–176.

*Primary Examiner*—Robert J. Spar
*Assistant Examiner*—R. B. Johnson
*Attorney, Agent, or Firm*—McGlew and Tuttle

[57] ABSTRACT

A coke oven door lifter for a coke oven door, having a horizontal support bar and a spring biased locking bar, includes a lifter housing or frame having a vertical trackway therein. A movable member is guided in the trackway for vertical upward and downward movement and it carries a support arm which is engageable with the horizontal support bar of the coke oven door to lift it when the movable member is moved upwardly. A locking bar release member comprises a piston displaceable in a fluid pressure controlled cylinder which is displaced after the movable member is moved upwardly to contact and disengage the locking bar. The movable member is moved by a piston movable in a fluid pressure cylinder after the lifter housing or frame is moved into association with the door.

3 Claims, 4 Drawing Figures

COKE OVEN DOOR LIFTER MECHANISM

BACKGROUND OF THE INVENTION

1. Field of the Invention

This invention relates in general to the construction of coke oven doors and, in particular, to a new and useful device for lifting and releasing a coke oven door.

2. Description of the Prior Art

The known devices for unlocking and supporting doors of coke ovens include very complicated mechanisms and they are assembled with cams and rings and control mechanisms which must be manipulated for their operation. Because the mechanisms are so complicated, they are difficult to operate and maintain and are relatively expensive.

SUMMARY OF THE INVENTION

In accordance with the present invention, there is provided a coke oven door lifter which includes a frame or housing which is displaceable toward and away from the coke oven door and which carries a movable member which is displaced upwardly under the force of a control fluid pressure to position an arm thereof beneath a horizontal bar of the coke oven door in order to engage it and lift the door. The movable member also carries a fluid pressure operated piston which is displaced after engagement of the support arm with the bar to move against a locking bar to unlock it and release the door to permit its upward lifting. The two fluid pressure operated cylinders for moving the movable member upwardly and downwardly in a trackway of the frame and for moving the unlocking piston to unlock the locking bar may be operated and controlled simply.

Accordingly, it is an object of the invention to provide an improved device for lifting a door of a coke oven, which includes simple fluid pressure operated mechanism for engaging and lifting the door and for unlocking the locking bar mechanism.

A further object of the invention is to provide a lifting door which includes a member movable along a guideway of a lifting door frame under the control of a fluid pressure operated piston, and wherein the member carries a support arm which moves upwardly to engage beneath a horizontal bar of a coke oven door, and wherein the movable member also carries a displaceable piston which is moved under the force of fluid pressure to move against a spring-biased locking bar and to unlatch the door.

A further object of the invention is to provide a coke oven door lifting device which is simple in design, rugged in construction and economical to manufacture.

The various features of the novelty which characterize the invention are pointed out with particularity in the claims annexed to and forming a part of this disclosure. For a better understanding of the invention, its operating advantages and specific objects attained by its uses, reference should be had to the accompanying drawings and descriptive matter in which there is illustrated a preferred embodiment of the invention.

DESCRIPTION OF THE PREFERRED EMBODIMENT

Figure 1:
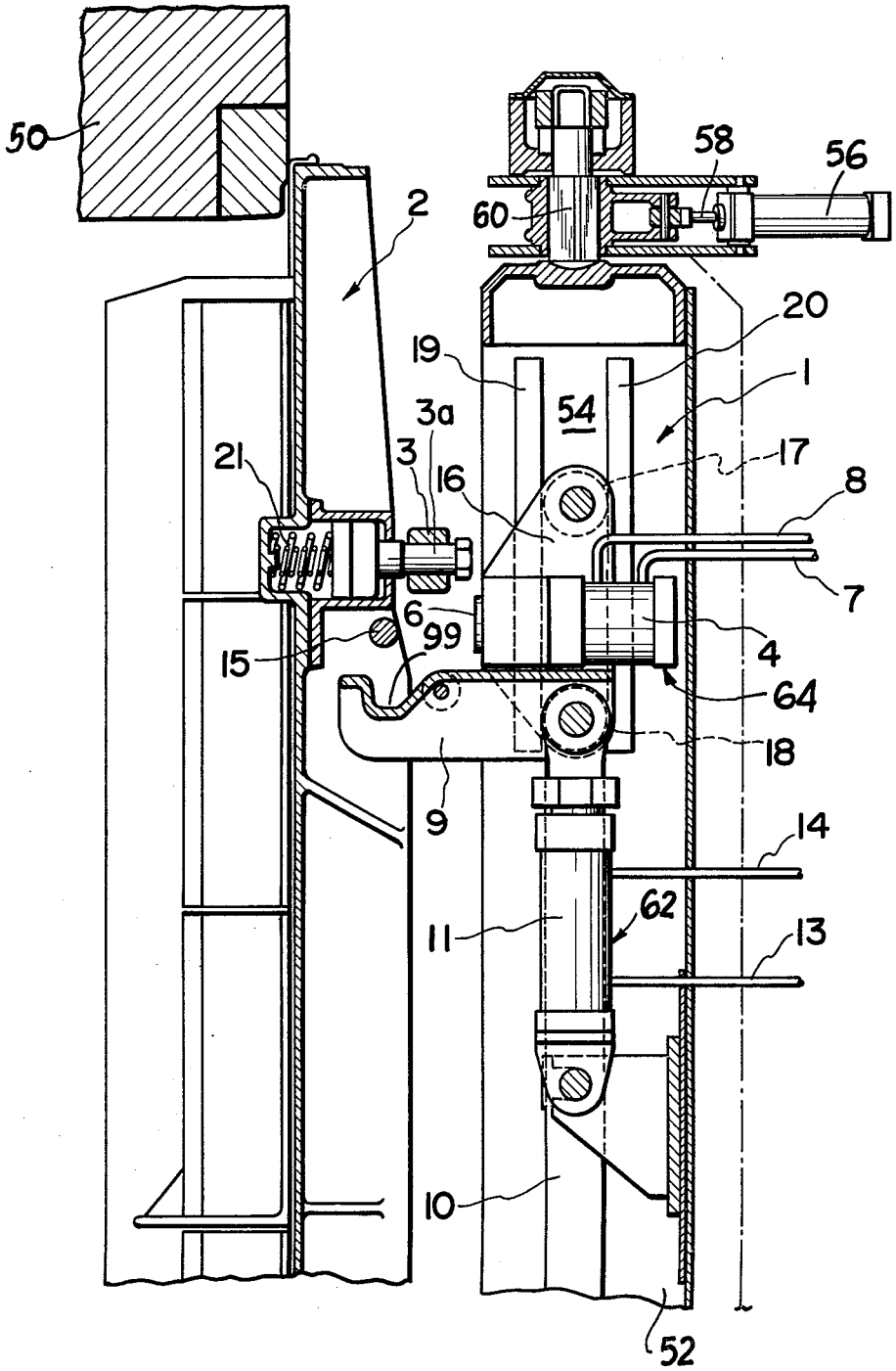
FIG. 1 is a partial transverse section of a coke oven door and lifter device constructed in accordance with the invention.

Referring to the drawings in particular, the invention embodied therein, comprises a door liftng apparatus, generally designated 1, for opening and lifting a coke oven door, generally designated 2, of a coke oven 50. Coke oven 50 includes a door 2 of a type which has a horizontally extending support bar 15 by which it may be lifted vertically and also includes a latching mechanism which includes a displaceable bar member 3 which is secured on a rod 3*a* which, in turn, is to urge the rod member 3 biased by a spring 21 into a latching position, but which may be moved against the force of the spring to open the door so that it may be removed and lifted.

The locking bar member 3 is connected to a door latch (not shown) which is locked when the bar member is urged to an outer portion shown in FIG. 1.

In accordance with the invention, the lifter 1 includes a door frame or housing 52 having a vertical trackway 54 therein which is defined between parallel spaced vertically extending rod members or guide tracks 19 and 20, respectively. The lifter frame 52 may be displaced under the control of a fluid pressure operated cylinder 56 which carries a piston having a displaceable connecting rod 58 which is connected to a bearing pin 60 of the frame 52.

Figure 2:
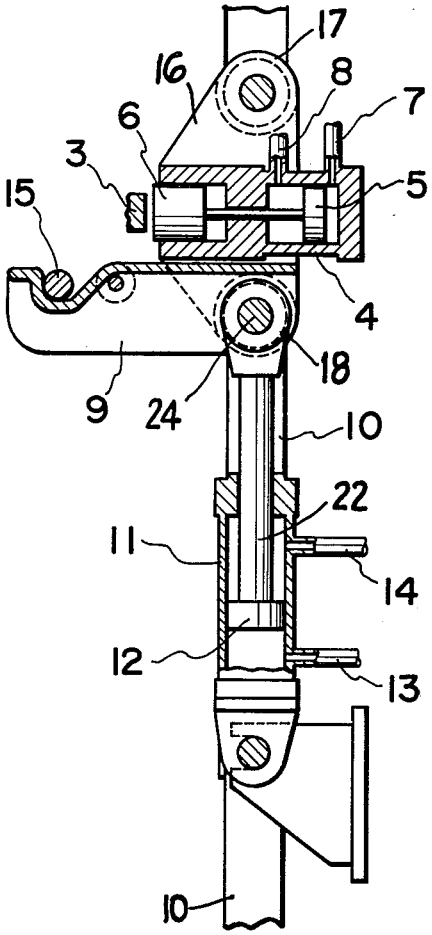
FIG. 2 is a partial sectional view indicating a portion of the mechanism of the lifter shown in FIG. 1.
Figure 3:
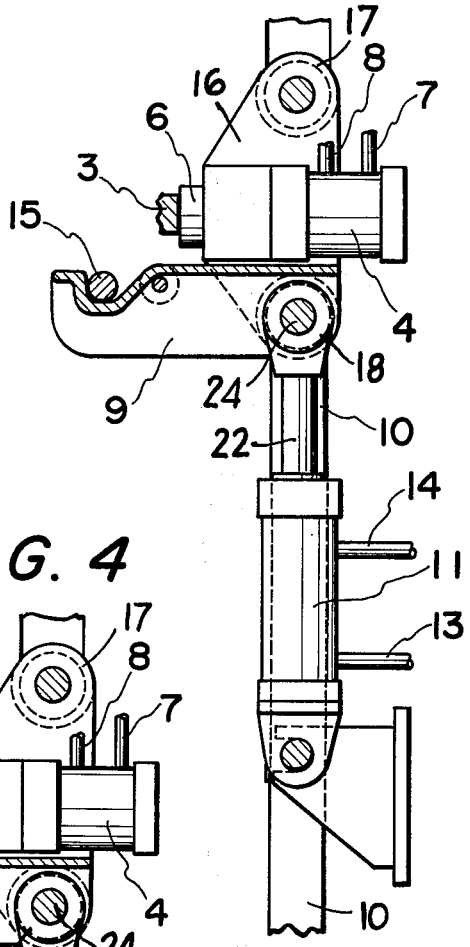
FIGS. 3 and 4 are views similar to FIG. 2 showing the various operating positions of the lifting mechanism.
Figure 4:
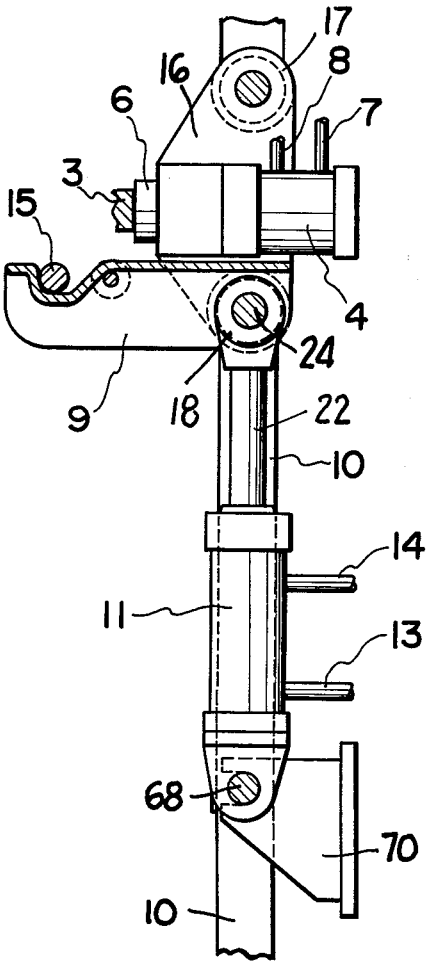

After the housing 52 is brought adjacent the door 2, first fluid pressure operable means, generally designated 62, are operated to raise a movable member 16 together with a support arm portion 9 associated therewith upwardly to engage a hook recess 99 of the support arm beneath the horizontal bar 15 of door 2. Movable member 16 carries rollers 17 and 18 at respective opposite ends which are guided in trackway 54. The first fluid pressure operated means includes a fluid pressure cylinder 11 having a piston therein which may be directed either upwardly or downwardly in accordance with whether pressure is directed through the fluid pressure connecting line 13 or the fluid pressure connecting line 14. Actuation of the first fluid pressure operated means 62 causes a movement from the lower non-operative position shown in FIG. 1 to the engaged position shown in FIG. 2. In the engaged position, second fluid pressure operated means, generally designated 64, are actuated in order to displace an unlocking member 6 to engage and move locking bar 3 of the door by actuating the door latch (not shown) to release the door. The second fluid pressure operated means 64 includes a fluid pressure cylinder 4 having a piston 5 slidable therein under the control of pressure admitted through either connecting lines 7 or 8 which may, for example, be hydraulic or oil lines. The second fluid pressure operated means 64 are operated in the position shown in FIG. 2 to cause a displacement of the unlocking member 6 against the locking bar 3, as shown in FIGS. 3 and 4. The fluid pressure cylinder 4 is carried on the support 16, whereas the fluid pressure cylinder 11 is pivotally mounted on a pivot 68 of a bracket 70.

The operating mechanism may comprise a similar duplicate set including another support member similar to the support member 16 which is connected to the support member by a connecting rod 10. Such devices are necessary in the event that there is a similar lifting or engagement of a bar similar to the bar 15 on the opposite side of door 2. The piston rod movable in the cylinder 11 is connected to a connecting rod 22 to an axle or bolt 24 carried by the movable member 16.

The fluid pressure which is directed into cylinder 11 through line 13 may be employed to lift the door as high as desired and to hold it in the lifted position. The door frame 52 may then be shifted by the fluid pressure cylinder 56, for example, to bring it together with the door into association with a door cleaning machine (not shown). When the door is to be replaced in the coke furnace opening, it is moved backwardly and the piston rod 22 is lowered to cause support 9 to release the door. It is advantageous to use a fluid pressure source such as a hydraulic or oil pressure supply which makes the control of the operation very simple.

While a specific embodiment of the invention has been shown and described in detail to illustrate the application of the principles of the invention, it will be understood that the invention may be embodied otherwise without departing from such principles.

What is claimed is:

1. A coke oven door lifter for a coke oven door having a horizontal support bar, comprising a coke oven door having a horizontal support bar, a door lifter housing having a vertical trackway, a movable member guided on said trackway for vertical upward and downward movement therealong, a support arm carried by said movable member engageable with the horizontal support bar of the coke oven door to lift it when said movable member is moved upwardly, a locking bar release member movably mounted on said movable member, first fluid pressure operable means connected to said movable member to displace it along said trackway, a locking bar carried by said door and being movable between a latching and unlatching position, spring means biasing said locking bar into an unlatching position, said bar being movable by said locking bar release member against said biasing means to an unlatching position, second fluid pressure operable means connected to said locking bar release member to displace said locking bar release member when said movable member is in a raised position and engaged with said support bar to engage said locking bar and move it to an unlatching position to release said door and third fluid pressure operated means engageable with said door lifter housing to displace said housing toward and away from the coke oven door.

2. A coke oven door lifter for a coke oven door, according to claim 1, wherein said movable member includes at least one roller engaged in said trackway for rolling movement therealong.

3. A coke oven door lifter for a coke oven door, according to claim 1, wherein said support arm includes a recessed hook portion engageable beneath said horizontal support bar.

* * * * *